US011409207B2

(12) United States Patent
Josiah et al.

(10) Patent No.: US 11,409,207 B2
(45) Date of Patent: Aug. 9, 2022

(54) METHOD AND SYSTEM FOR CONVERTING A TONER CARTRIDGE PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

(21) Appl. No.: 17/079,151

(22) Filed: Oct. 23, 2020

(65) Prior Publication Data

US 2021/0041799 A1 Feb. 11, 2021

Related U.S. Application Data

(63) Continuation-in-part of application No. 16/402,718, filed on May 3, 2019, now abandoned, which is a (Continued)

(51) Int. Cl.
*G03G 15/01* (2006.01)
*G03G 15/08* (2006.01)
*G03G 15/00* (2006.01)

(52) U.S. Cl.
CPC ..... *G03G 15/0121* (2013.01); *G03G 15/0877* (2013.01); *G03G 15/6585* (2013.01)

(58) Field of Classification Search
CPC ..... G03G 15/6585; G03G 15/0121; G03G 15/0894; G03G 2215/00987; G03G 15/0863; G03G 2215/0888; G03G 15/0877
See application file for complete search history.

(56) References Cited

U.S. PATENT DOCUMENTS 6,249,655 B1 6/2001 Baek
2003/0165766 A1* 9/2003 Zhang ..... G03G 9/08764 430/108.1

(Continued)

FOREIGN PATENT DOCUMENTS

JP 2009196118 9/2009

OTHER PUBLICATIONS

The International Searching Authority, International Search Report, dated Aug. 31, 2021, 4 pages, United States.

(Continued)

*Primary Examiner* — Jessica L Eley
(74) *Attorney, Agent, or Firm* — Hankin Patent Law, APC; Kevin Schraven; Anooj Patel

(57) ABSTRACT

A method of converting a CMYW toner printer to print with one or more non-standard toners, comprising the steps: providing a CMYW toner printer; wherein the CMYW toner printer has four starting toner printing cartridges; wherein the four starting toner printing cartridges comprise a white toner printing cartridge, a cyan toner printing cartridge, a magenta toner printing cartridge, and a yellow toner printing cartridge; removing one or more of the four starting toner printing cartridges from the CMYW toner printer, such that there are one or more empty toner cartridge slots; providing one or more non-standard toner printing cartridges that are each filled with one type of one or more non-standard toners; and installing the one or more non-standard toner printing cartridges into the one or more empty toner cartridge slots.

14 Claims, 5 Drawing Sheets

Related U.S. Application Data continuation-in-part of application No. 15/944,750, filed on Apr. 3, 2018, now Pat. No. 10,687,203, and a continuation-in-part of application No. 15/800,482, filed on Nov. 1, 2017, now Pat. No. 10,310,446, and a continuation-in-part of application No. 15/722,562, filed on Oct. 2, 2017, now Pat. No. 10,324,395, and a continuation-in-part of application No. 15/722,503, filed on Oct. 2, 2017, now Pat. No. 10,228,637, said application No. 15/944,750 is a continuation-in-part of application No. 15/722,503, filed on Oct. 2, 2017, now Pat. No. 10,228,637, said application No. 15/800,482 is a continuation-in-part of application No. 15/408,186, filed on Jan. 17, 2017, now Pat. No. 9,835,968, and a continuation-in-part of application No. 15/286,875, filed on Oct. 6, 2016, now Pat. No. 9,835,981, and a continuation-in-part of application No. 15/286,943, filed on Oct. 6, 2016, now Pat. No. 9,835,982, and a continuation-in-part of application No. 15/286,998, filed on Oct. 6, 2016, now Pat. No. 9,835,983, and a continuation-in-part of application No. 14/879,548, filed on Oct. 9, 2015, now Pat. No. 9,488,932, and a continuation-in-part of application No. 14/731,785, filed on Jun. 5, 2015, now Pat. No. 9,383,684.

(60) Provisional application No. 62/470,639, filed on Mar. 13, 2017.

(56) References Cited

U.S. PATENT DOCUMENTS

| | | | | |
|---|---|---|---|---|
| 2012/0237243 | A1* | 9/2012 | Yamamoto | G03G 15/6585 399/67 |
| 2012/0301163 | A1* | 11/2012 | Hirata | G03G 15/0131 399/49 |
| 2013/0108345 | A1* | 5/2013 | Yamamoto | G03G 15/5087 400/76 |
| 2013/0330522 | A1 | 12/2013 | Suzuki | |

OTHER PUBLICATIONS

The International Searching Authority, International Search Report, dated Sep. 1, 2021, 4 pages, United States.

The International Searching Authority, Written Opinion of the International Searching Authority, dated Aug. 31, 2021, 4 pages, United States.

The International Searching Authority, Written Opinion of the International Searching Authority, dated Sep. 1, 2021, 4 pages, United States.

* cited by examiner

METHOD AND SYSTEM FOR CONVERTING A TONER CARTRIDGE PRINTER

CROSS-REFERENCE TO RELATED APPLICATIONS

This patent application is a Continuation-in-Part application of U.S. Non-Provisional patent application Ser. No. 16/402,718, titled Method For Converting A Toner Cartridge Printer To A Security Toner Printer, filed on May 3, 2019, the contents of which are expressly incorporated herein by this incorporated herein by this reference as though set forth in their entirety and to which priority is claimed. U.S. Non-Provisional patent application Ser. No. 16/402,718 is a Continuation-in-Part application of U.S. Non-Provisional patent application Ser. No. 15/800,482, titled Method For Converting A Toner Cartridge Printer To A Sublimation Toner Printer, filed on Nov. 1, 2017, now U.S. Pat. No. 10,310,446, the contents of which are expressly incorporated herein by this reference as though set forth in their entirety and to which priority is claimed. U.S. Non-Provisional patent application Ser. No. 15/800,482 takes priority from U.S. Provisional Patent Application No. 62/470,639, filed on Mar. 13, 2017, titled Toner Cartridge Printer Devices, Systems, and Methods, the contents of which are expressly incorporated herein by this reference as though set forth in their entirety and to which priority is claimed. U.S. Non-Provisional patent application Ser. No. 16/402,718 is also a Continuation-in-Part application of U.S. Non-Provisional patent application Ser. No. 15/722,562, titled Toner Cartridge Printer Devices, Systems, And Methods For Under Printing, filed on Oct. 2, 2017, now U.S. Pat. No. 10,324,395, the contents of which are expressly incorporated herein by this reference as though set forth in their entirety and to which priority is claimed. U.S. Non-Provisional patent application Ser. No. 15/800,482, is a Continuation-in-Part of the following U.S. Non-Provisional patent application Nos., which means that this U.S. patent application is also a Continuation in Part of the following U.S. Non-Provisional patent application Nos.: (1) Ser. No. 15/408,186, filed on Jan. 17, 2017, titled, Toner Cartridge Printer Devices, Systems, and Methods For Over Printing and Under Printing, now U.S. Pat. No. 9,835,968; (2) Ser. No. 15/286,998, filed on Oct. 6, 2016, titled, Method and System for Converting a Toner Cartridge Printer to a Double White Toner Printer, now U.S. Pat. No. 9,835,983; (3) Ser. No. 15/286,943, filed on Oct. 6, 2016, titled Method And System For Converting A Toner Cartridge Printer To A White, Clear, Metallic, Fluorescent, Or Light Toner Printer, now U.S. Pat. No. 9,835,982; (4) Ser. No. 15/286,875, filed on Oct. 6, 2016, titled, Method and System for Converting a Toner Cartridge Printer to a Metallic, Clear Fluorescent, or Light Toner Printer, now U.S. Pat. No. 9,835,981; (5) Ser. No. 14/879,548, now U.S. Pat. No. 9,488,932, filed on Oct. 9, 2015, titled, Method and System for Converting a Toner Cartridge Printer to a White, Clear, or Fluorescent Toner Printer; (6) Ser. No. 14/731,785, now U.S. Pat. No. 9,383,684, filed on Jun. 5, 2015, titled, Method and System for Converting a Toner Cartridge Printer to a White Toner Printer; the contents of all of which are expressly incorporated herein by this reference as though set forth in their entirety and to which priority is claimed as Continuation-in-Part. U.S. Non-Provisional patent application Ser. No. 16/402,718 is also a Continuation-in-Part application of U.S. Non-Provisional patent application Ser. No. 15/944,750, titled Method And System For Converting A Toner Cartridge Printer, filed on May 31, 2018, now U.S. Pat. No. 10,649,372, the contents of which are expressly incorporated herein by this reference as though set forth in their entirety and to which priority is claimed. U.S. Non-Provisional patent application Ser. No. 16/402,718 is also a Continuation-in-Part application of U.S. Non-Provisional patent application Ser. No. 15/722,503, filed on Oct. 17, 2017, titled Method and System For Converting A Toner Cartridge Printer to a Metallic Or Light Toner Printer, now U.S. Pat. No. 10,229,637. U.S. Non-Provisional patent application Ser. No. 15/944,750, is a Continuation-in-Part of U.S. Non-Provisional patent application Ser. No. 15/722,503, filed on Oct. 17, 2017, titled Method And System For Converting A Toner Cartridge Printer To A Metallic Or Light Toner Printer, now U.S. Pat. No. 10,228,637.

FIELD OF USE

The present disclosure relates generally to printer cartridge replacement. More specifically, this disclosure relates to methods and systems of converting a white toner cartridge printer to a printer that prints with at least one non-standard toner.

BACKGROUND

Cyan (C), Magenta (M), Yellow (Y), and White (W) (or CMYW) laser or Light Emitting Diode (LED) type printers come standard with Cyan, Magenta, Yellow, and White toner and/or drum cartridges. However, CMYW toner printers are generally unable to be converted to print with toner other than cyan, magenta, yellow, and white, as these printers lack the appropriate toner and/or drum cartridges and the appropriate raster image processor (RIP) software for printing cartridge re-mapping.

Thus, there is a need for a system and method for converting a standard CMYW (four cartridge) toner printer to print using a non-standard color, such as clear, fluorescent, sublimation, metallic, or clear fluorescent.

SUMMARY OF EMBODIMENTS

To minimize the limitations in the cited references, and to minimize other limitations that will become apparent upon reading and understanding the present specification, the toner printer converting, refilling, and refurbishment systems and methods disclosed herein preferably allow a user to convert a CMYW printer into one that prints using non-standard toner, including clear, clear fluorescent, fluorescent, metallic gold, metallic silver, light colors, ceramic toners, security toners, and sublimation toners. For purposes of this disclosure, white is not a non-standard toner.

In various embodiments, the methods and systems may be used to convert a four cartridge white toner cartridge(s) and/or drum(s) printing machine to a printing machine that prints clear, clear fluorescent, fluorescent, metallic gold, metallic silver, light colors, ceramic toners, security toners, and sublimation toners.

In one embodiment, a white CMYW toner cartridge printer is converted by replacing one of the standard color or white toner printing cartridges, from any slot, with a non-standard toner cartridge and then using raster image processing (RIP) software to match or set in which printer slot each of the cartridges resides.

In another embodiment, a standard toner cartridge printer is converted by replacing the color or white toner printing cartridge in the last toner printing cartridge position, which allows the printer to print clear, clear fluorescent, fluorescent, metallic gold, metallic silver, and/or light colors as a foreground color. The RIP software may allow a user to set how much non-standard toner should be added to maximize the look of the finished print job.

In one embodiment, the cartridge re-mapping is used to allow a clear, clear fluorescent, fluorescent, metallic gold, metallic silver, light colors, security, sublimation, or non-standard toner printing cartridge to be put in the "W" (White) slot (which may be the first slot in the printer) of a CYMW printer and the CYM cartridges are all in their original slots. In this manner, a layer of non-standard toner may be put down, on top of which a full color layer may be printed, and may be used on clear and dark media.

In one embodiment the printing cartridge integrated circuits (chips) may be swapped along with the toner printing cartridges, and the RIP software is configured to ensure that the correct colors print regardless of which slot the colors or non-standard toner cartridges are placed.

The RIP software may allow or feature color rasterization, which enables the printer to use less toner by selectively removing pixels to use less toner. This feature gives a nicer feel and ads more durability to the finished product.

One embodiment may be a method of converting a CMYW toner printer to print with one or more non-standard toners, comprising the steps: providing a CMYW toner printer; wherein the CMYW toner printer has four starting toner printing cartridges; wherein the four starting toner printing cartridges comprise a white toner printing cartridge, a cyan toner printing cartridge, a magenta toner printing cartridge, and a yellow toner printing cartridge; removing one or more of the four starting toner printing cartridges from the CMYW toner printer, such that there are one or more empty toner cartridge slots; providing one or more non-standard toner printing cartridges that are each filled with one type of one or more non-standard toners; and installing the one or more non-standard toner printing cartridges into the one or more empty toner cartridge slots. The method may also comprise providing raster image processor (RIP) software, such that the CMYW toner printer is able to incorporate the one or more non-standard toner into one or more images printed by the CMYW toner printer. The RIP software allows for remapping of the CMYW toner printer. The one or more non-standard toner printing cartridges may each have an appropriate chip, such that when the one or more non-standard toner printing cartridges are installed in the CMYW printer the appropriate chip is configured to allow the one or more non-standard toner printing cartridges to be recognized by the CMYW toner printer. The one or more non-standard toner printing cartridges may be selected from the group of non-standard toner printing cartridges consisting of: clear and clear fluorescent. The one or more non-standard toner printing cartridge may be selected from the group of non-standard toner printing cartridges consisting of: clear; clear fluorescent; metallic, ceramic, light/pastel; sublimation, and security. The CMYW toner printer may be a laser toner printer. The CMYW toner printer may be a LED toner printer.

One embodiment may be a method of converting a CMYW toner printer to print with a non-standard toner, comprising the steps: providing a CMYW toner printer; wherein the CMYW toner printer has four starting printing cartridges; wherein the four starting printing cartridges comprise a white toner printing cartridge, a cyan toner printing cartridge, a magenta toner printing cartridge, and a yellow toner printing cartridge; removing the white toner printing cartridge from the CMYW toner printer, such that there is an empty toner cartridge slot; providing a non-standard toner printing cartridge that is filled with a non-standard toner; and installing the non-standard toner printing cartridge into the empty toner cartridge slot. The method may also comprise the step of providing raster image processor (RIP) software, such that the CMYW toner printer is able to incorporate the non-standard toner into one or more images printed by the CMYW toner printer. The RIP software may allow for remapping of the CMYW toner printer. The non-standard toner printing cartridge may have an appropriate chip, such that when the non-standard toner printing cartridge is installed in the CMYW printer the appropriate chip is configured to allow the non-standard toner printing cartridge to be recognized by the CMYW toner printer. The non-standard toner printing cartridge may be selected from the group of non-standard toner printing cartridges consisting of: clear; clear fluorescent; metallic, ceramic, light/pastel; sublimation, and security. The CMYW toner printer may be a laser toner printer. The CMYW toner printer may be a LED toner printer. The non-standard toner printing cartridge may be selected from the group of non-standard toner printing cartridges consisting of: clear and clear fluorescent. The empty slot may be a first cartridge position and the non-standard toner printing cartridge is installed into the first cartridge position and the non-standard toner is configured to underprint. The empty slot may be a fourth cartridge position and the non-standard toner printing cartridge is installed into the fourth cartridge position and the non-standard toner is configured to overprint.

The non-standard toner printing cartridge may be selected from the group of non-standard toner printing cartridges consisting of: white; clear; clear fluorescent; metallic, ceramic, sublimation, and security. The printer may be a laser toner printer or a LED toner printer.

In one embodiment the printer may comprise raster image processor (RIP) software, such that the printer is able to incorporate the non-standard toner(s) into one or more images printed by the printer. The RIP software allows for remapping of the printer. The RIP software may also allow black to be printed using cyan, magenta, and yellow (the amount of each may be set or determined by RIP; usually 50-80% of each color is used to create a rich black). The cyan, magenta, and yellow, if replaced may be non-standard toners, such as cyan sublimation, yellow security, magenta ceramic, fluorescent cyan, pastel (light) yellow, etc. Depending on the specific contents of the non-standard toners that are swapped in, printing in rich black may not be possible.

Clear fluorescent toner is desirable because it may only be visible under an ultraviolet light.

In some embodiments, once the non-standard toner cartridges have been swapped in, the printer settings and/or RIP software may allow the user to utilize those swapped in toners by telling the printer to print using the toners that were removed. So, for example, if the cyan toner cartridge was removed, then the printer may print 100% cyan to print using the swapped in cartridge.

It is an object of the present system and method for converting a CMYW toner cartridge printer into a printer that has at least one non-standard printing cartridge printer that has at least one non-standard printing cartridge.

It is an object of the present system and method for raster image processor software to provide cartridge remapping, which allows the system to print using a non-standard toner from different cartridge positions.

In one embodiment of the system and method may use new empty or recycled empty toner cartridges that have been pre-cleaned and filed with a non-standard toner. In this embodiment the original cartridge(s) that are removed do not have to be cleaned and filed, they can immediately be replaced by a prefilled new or used cartridge.

Other features and advantages inherent in the system and method for converting a standard toner cartridge printer into white, metallic, or light toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
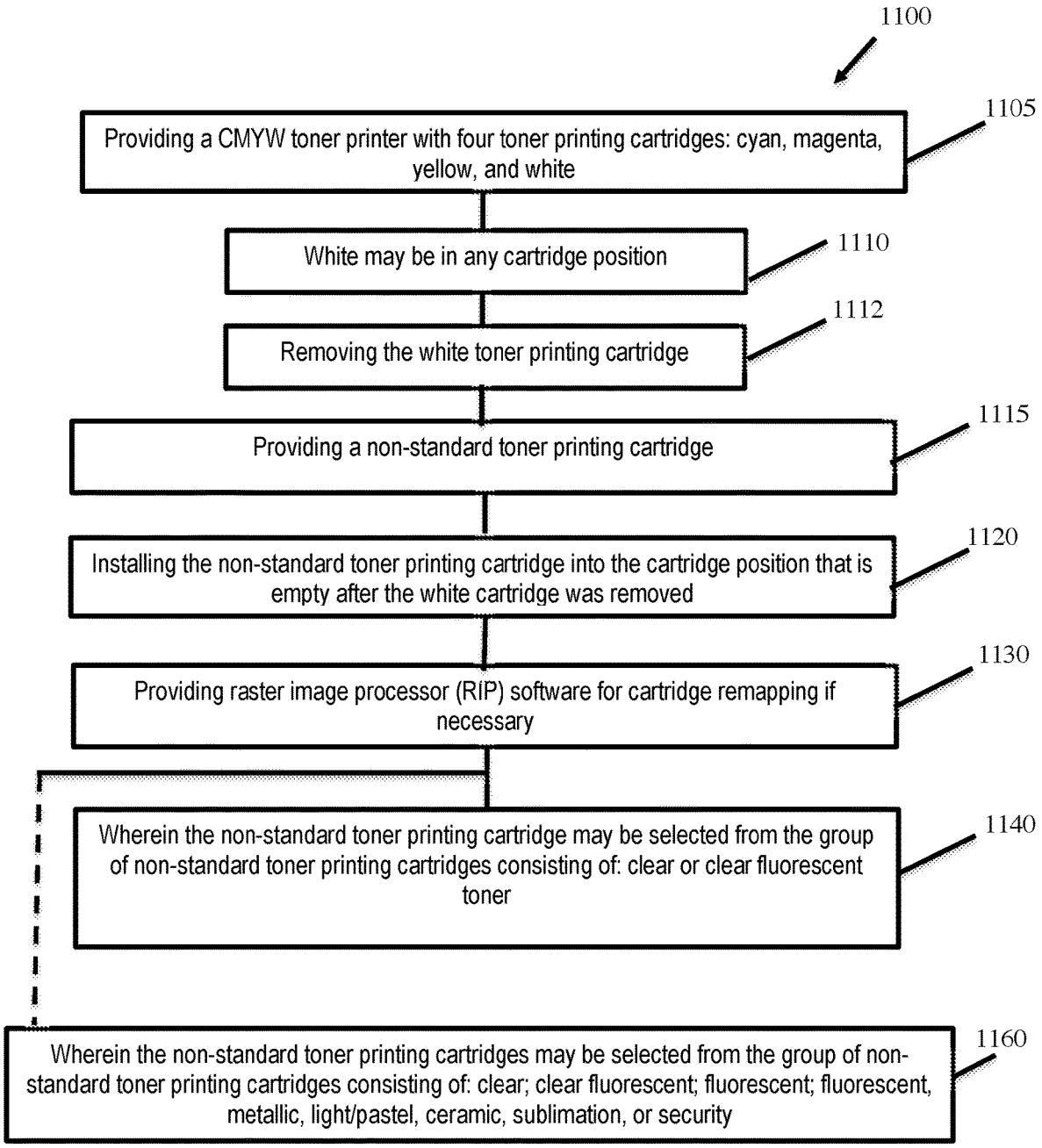
FIG. 1 is a flow block diagram of one embodiment of the method of converting a CMYW toner printer to print with a non-standard toner with a single cartridge conversion.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYW printer, the letter "W" preferably stands for white.

Regarding a CMYX printer, the letter "X" refers to a non-standard toner or toner color, such as metallic, fluorescent, light, clear, clear fluorescent, ceramic, and/or sublimation.

The term transfer material may typically refer to a polyurethane media that accepts the toner print job and then allows the print job to be transferred to a final print surface via heat transfer. The transfer material may also be constructed from any suitable material, such as a specially coated paper or even just plain paper. The final print surface is preferably plastic or polymer, such as, for example, a polyester shirt or product.

The present specification discloses a system and method for converting a four cartridge white toner cartridge printer to a non-standard toner printer. The method and system for converting a toner cartridge printer to a non-standard toner printer preferably requires no special or dedicated printer drivers.

The present method and system for converting a white toner cartridge printer to a clear, clear fluorescent, fluorescent, metallic gold, metallic silver, light colors, ceramic toners, security, and/or sublimation toner printer may allow the conversion of: (1) a conversion of a CMYW machine that has combined toner and drum cartridges; (2) a conversion of a CMYW machine that has separate toner and drum cartridges; and (3) a conversion of a CMYW machine with a single drum and separate toner printing cartridges.

Regarding the conversion of a CMYW machine that has a separate toner and drum cartridges, the conversion may comprise replacing one or more of the color cartridges or the white cartridge with one or more non-standard toner printing cartridge and replacing the accompanying one or more drums with one or more non-standard drum.

Regarding the conversion of a CMYW machine that has separate toner printing cartridges, but a single drum cartridge, the conversion may comprise replacing the white or one or more of the color cartridges with one or more non-standard toner printing cartridge and cleaning the accompanying drum portion of the respective toner(s) and priming it with non-standard toner(s).

One embodiment of the present disclosure may be replacing the white toner cartridge with a clear or clear fluorescent toner cartridge. Typically, the white cartridge may be in a first or fourth position, which allows for under or over printing, respectively. Thus, when the clear or fluorescent toner cartridges are swapped in, they may under or over print, similar to how the white toner cartridge was used. This over and under printing with the clear, clear fluorescent, or any other type of non-standard toner may be done in a single pass by using raster image processing (RIP) software.

In another embodiment, the one or more non-standard toner printing cartridges may be provided by disassembling the removed printing cartridges to create one or more empty cartridges, which are then cleaned and refilled with a non-standard toner.

In one embodiment, the starting cyan, yellow, magenta, and white toner printing cartridges are original/new cartridges. In another embodiment the starting cyan, yellow, magenta, and white toner printing cartridges themselves were previously used and/or refurbished.

In various embodiments the positioning of the non-standard toner cartridge(s) and the programming of the RIP software allows the user to print with the non-standard toner cartridge(s) concurrently with the other colors in a single layer or print the non-standard toner as a separate layer before and/or after the other colors have printed.

FIG. 1 is a flow block diagram of one embodiment of the method of converting a CMYW toner printer to print with a non-standard toner with a single cartridge conversion. FIG. 1 shows that the method 1100 may comprise the steps: providing a CMYW toner printer with four toner printing cartridges, cyan (C), magenta (M), yellow (Y), and white (W) 1105; the cartridges may be in any order and the white cartridge may be in any position 1110; removing the white toner printing cartridge 1112; providing a non-standard toner printing cartridge 1115; installing the non-standard toner printing cartridge into the cartridge position that is empty after the white cartridge was removed 1120; providing raster image processor (RIP) software for cartridge remapping if necessary 1130; wherein the non-standard toner printing cartridges are selected from the group of non-standard toner printing cartridges consisting of: clear and clear fluorescent 1140; the RIP software may allow the printer to recognize the non-standard toner printing cartridge and specifically incorporate that toner into the image; and; wherein the non-standard toner printing cartridges may be selected from the group of non-standard toner printing cartridges consisting of: clear; clear fluorescent, metallic, fluorescent, light/pastel, ceramic, sublimation, and security 1160. The non-standard toner cartridges may each have a chip that allows the printer to recognize that the non-standard toner has replaced the white cartridge, so that RIP software may automatically recognize what non-standard color has been put into the printer to replace the white toner cartridge. In other embodiments, the user may manually enter into the RIP software what non-standard toner was inserted into the printer. The RIP software is configured to allow the printer to print images that incorporate the non-standard toner. In some embodiments, the user may move around the three starting color toners after taking out the white toner. The non-standard toner is then inserted into the empty slot and the RIP software is used to remap the printer.

Figure 2:
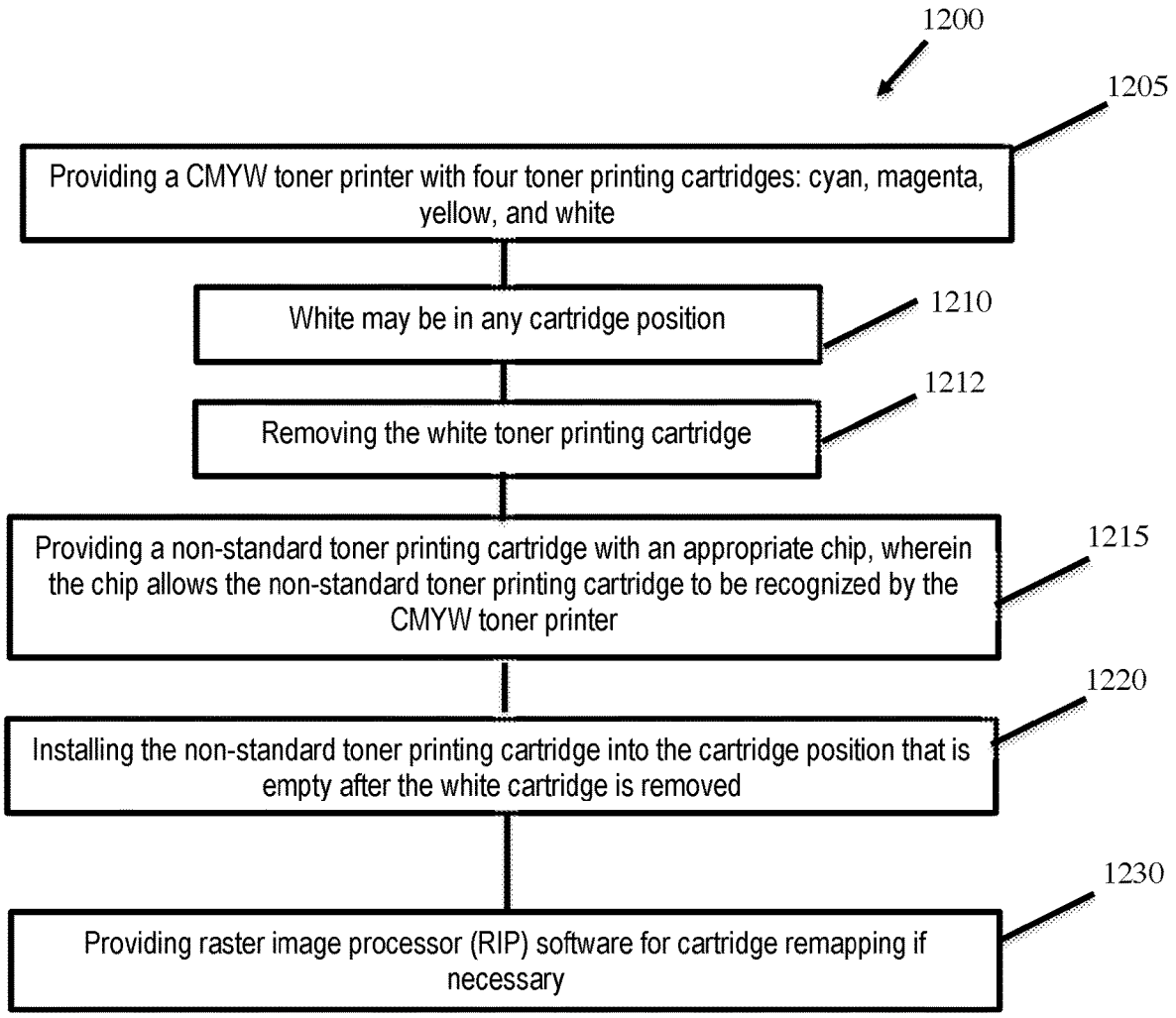
FIG. 2 is a flow block diagram of one embodiment of the method of converting a CMYW toner printer to a CMYX toner with a multiple cartridge conversion.

FIG. 2 is a flow block diagram of one embodiment of the method of converting a standard CMYW toner printer to a CMYX toner with a single cartridge conversion. FIG. 2 shows that the method 1200 may comprise the steps: providing a CMYW toner printer with four toner printing cartridges, cyan (C), magenta (M), yellow (Y), and white (W) 1205; the cartridges may be in any order and the black cartridge may be in any position 1210; removing the black toner printing cartridge 1212; providing a white toner printing cartridge with an appropriate chip, wherein the chip allows the white toner printing cartridge to be recognized by the CMYW toner printer 1215; installing the white toner printing cartridge into the cartridge position that is empty after the black cartridge was removed 1220; providing raster image processor (RIP) software for cartridge remapping if necessary 1230; the RIP software may: (1) allow the printer to recognize the white toner printing cartridge and specifically incorporate that toner into the image; and (2) allow black to be printed using cyan, magenta, and yellow 1240 (the amount of each may be set or determined by RIP; usually 50-80% of each color is used to create a rich black). The white toner may have a chip that allows the printer to recognize that the non-standard toner has replaced the black cartridge, so that RIP software may automatically set black to print using of each of the color toners and automatically recognize what non-standard color has been put into the printer to replace the black toner cartridge. In other embodiments, the user may manually enter into the RIP software that the white toner was inserted into the printer. The RIP software is configured to allow the printer to print images that incorporate the white toner. In some embodiments, the user may move around the three color toners after taking out the black toner. The white toner is then inserted into the empty slot and the RIP software is used to remap the printer.

Figure 3:
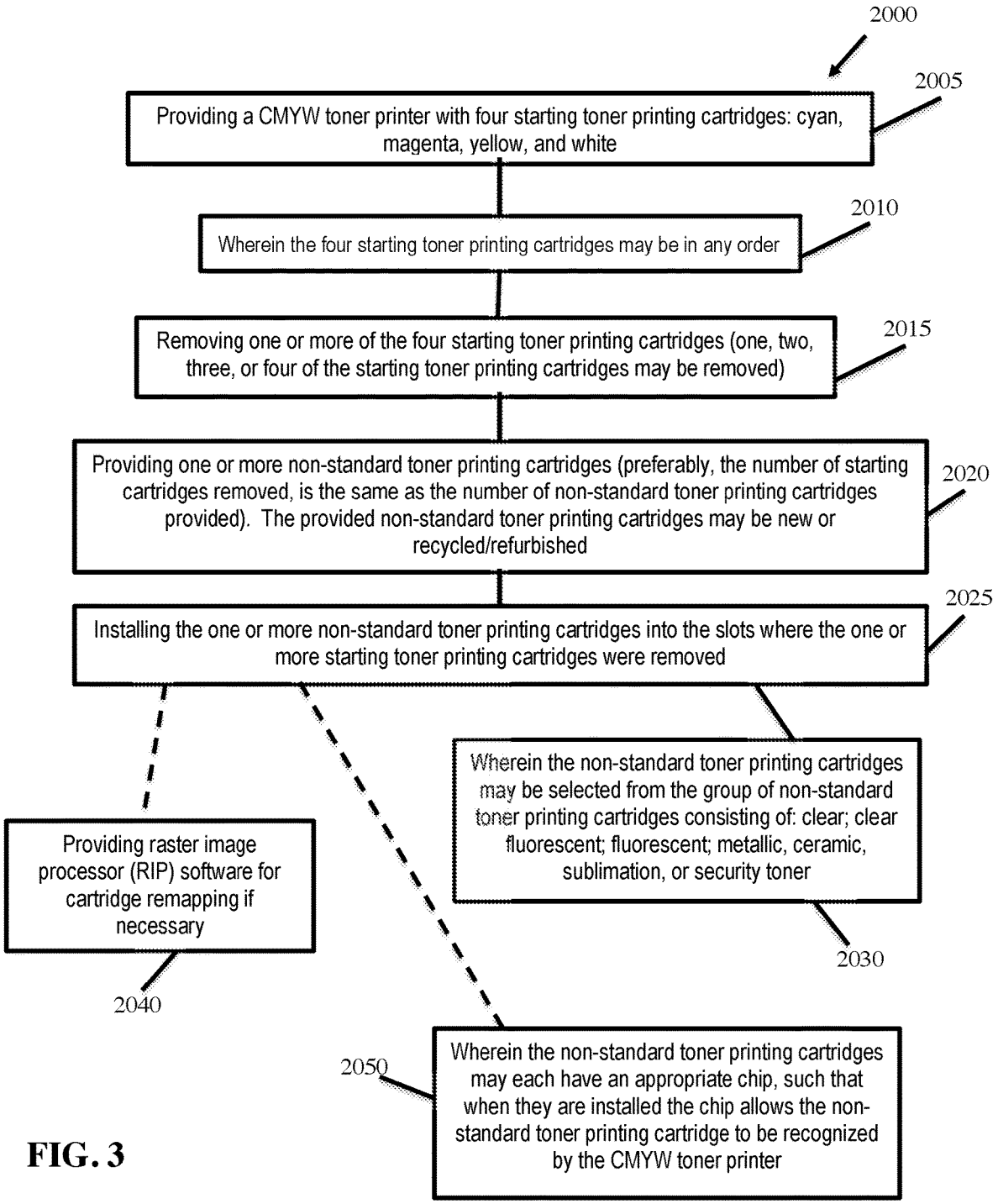
FIG. 3 is a flow block diagram of one embodiment of the method of converting a CMYW toner printer to print with one or more non-standard toner printing cartridges.

FIG. 3 is a flow block diagram of one embodiment of the method of converting a CMYW toner printer to print with one or more non-standard toner printing cartridges. FIG. 3 shows that the method of converting a CMYW toner printer 2000 may comprise the steps: providing a CMYW toner printer with four toner printing cartridges: cyan (C), magenta (M), yellow (Y), and white (W) 2005; wherein the four toner printing cartridges may be in any order 2010 within the CMYW toner printer; removing one or more of the four toner printing cartridges (one, two, three, or four of the starting toner printing cartridges may be removed) 2015; providing one or more non-standard toner printing cartridges (preferably, the number of starting cartridges removed, is the same as the number of non-standard toner printing cartridges provided); the provided non-standard toner printing cartridges may be new or recycled/refurbished 2020; and installing the one or more non-standard toner printing cartridges into the slots where the one or more starting toner printing cartridges were removed 2025. In some embodiments, the non-standard toner printing cartridges may be selected from the group of non-standard toner printing cartridges consisting of: clear; clear fluorescent; fluorescent; metallic, ceramic, sublimation, or security toner 2030. In some embodiments, the method may further comprise providing raster image processor (RIP) software for cartridge remapping if necessary 2040. In another embodiment, the non-standard toner printing cartridges each have an appropriate chip, such that when they are installed the chip allows the non-standard toner printing cartridge to be recognized by the CMYW toner printer 2050.

Figure 4:
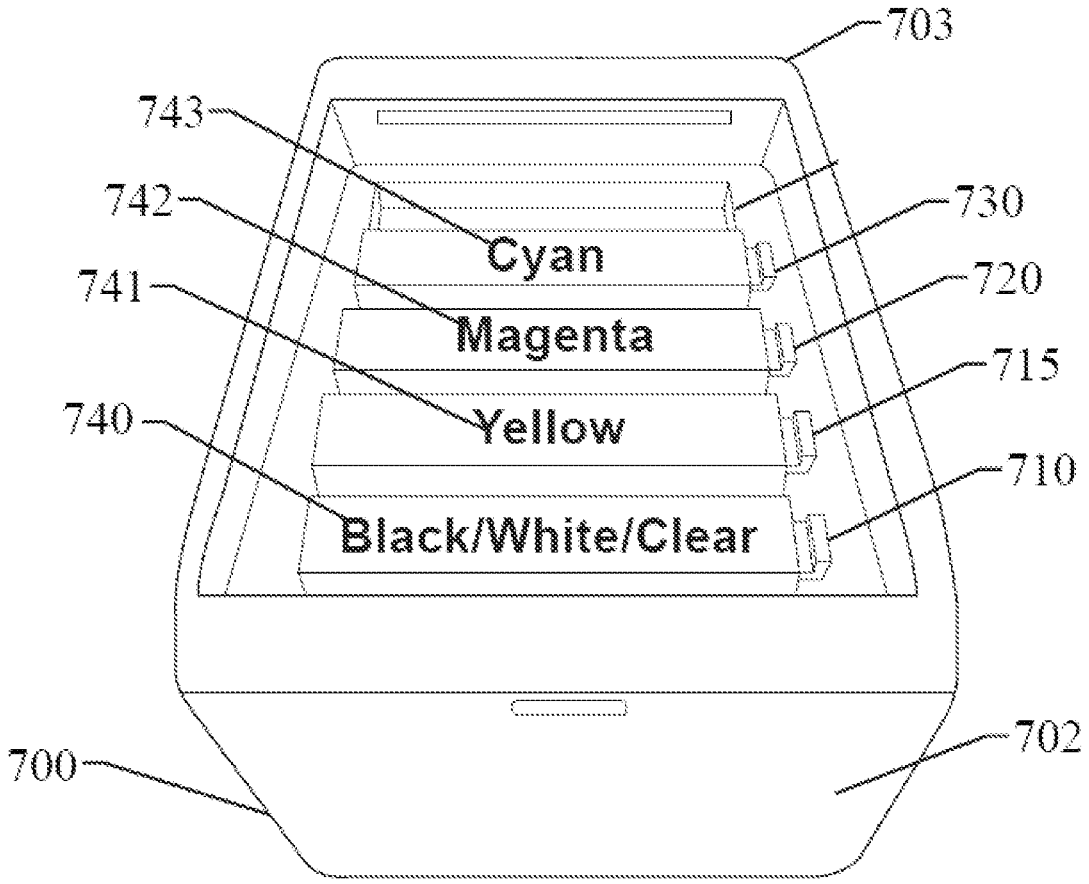
FIG. 4 is an illustration of one embodiment of a printer.

In some embodiments, the method may comprise, as examples and not by limitation:

- removing all four starting toner cartridges and replacing them with four CMYW sublimation toner cartridges
- removing all four starting toner cartridges and replacing them with three CMY fluorescent cartridges and a clear toner cartridge
- removing all four starting toner cartridges and replacing them with three CMY fluorescent cartridges and a clear fluorescent toner cartridge removing all four starting toner cartridges and replacing them with three CMY light/pastel cartridges and a clear toner cartridge removing all four starting toner cartridges and replacing them with three CMY light/pastel cartridges and a clear fluorescent toner cartridge removing the three CMY colored cartridges and replacing them with CMY fluorescent cartridges removing the three CMY colored cartridges and replacing them with three CMY light/pastel cartridges removing the yellow cartridge and replacing it with gold metallic removing the white cartridge and replacing it with gold metallic, silver metallic, white metallic, or clear metallic removing the white cartridge and replacing it with clear fluorescent or clear removing all three starting color toner cartridges and replacing them with gold metallic, silver metallic, and clear removing all four starting toner cartridges and replacing them with gold metallic, silver metallic, and clear, and fluorescent white removing all three starting color toner cartridges and replacement them with gold metallic, silver metallic, and fluorescent clear removing all four starting toner cartridges and replacing them with gold metallic, silver metallic, and fluorescent clear, and fluorescent white any combination of the above and the swapping may or may not include matching similar incoming toners to the outgoing toners FIG. 4 is an illustration of one embodiment of a CMYW printer 700 with four toner cartridges, white 740, yellow 741, magenta 742, and cyan 743, which are in, respectively, cartridge slots 710, 715, 720, and 730. One or more of the cartridges 740, 741, 742, 743 may be removed and another cartridge may be swapped in, such as black or clear (which is an X cartridge). FIG. 7 shows that the white 740 cartridge may start (or end up in) the first slot at the front 702 of the printer 700. FIG. 8 shows the white 740 may start (or end up in) the last slot at the rear 703 of the printer 700.

Figure 5:
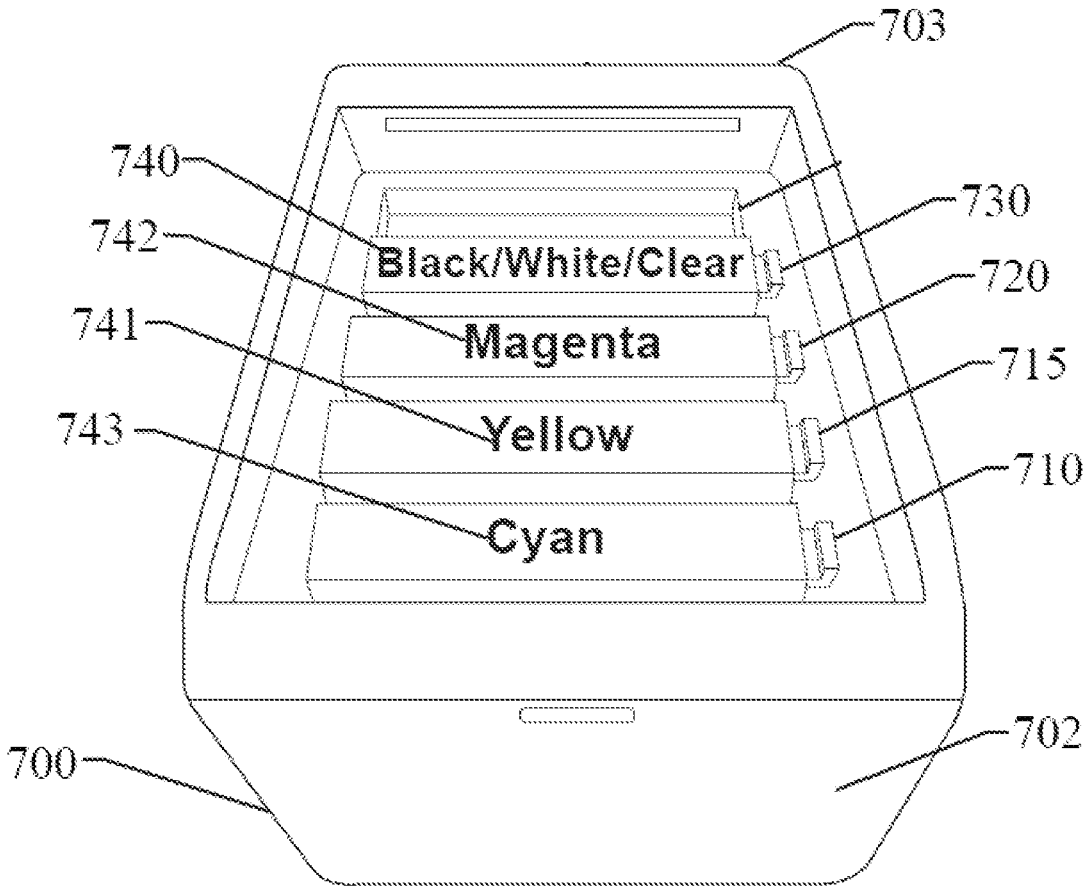
FIG. 5 is an illustration of another embodiment of a printer.

FIG. 5 is an illustration of another embodiment of a CMYW printer 700 with four toner cartridges, white 740, magenta 742, yellow 741, and cyan 743, which are in, respectively, cartridge slots 730, 720, 715, and 710. One or more of the cartridges 740, 741, 742, 743 may be removed and another cartridge may be swapped in, such as black or clear (which is an X cartridge). FIG. 8 shows the white 740 may start (or end up in) the last slot at the rear 703 of the printer 700.

In some embodiments, the removed starting toner Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a CMYW toner printer to print with one or more non-standard toners, comprising the steps:

providing a CMYW toner printer;

wherein said CMYW toner printer has four starting toner printing cartridges;

wherein said four starting toner printing cartridges comprise a white toner printing cartridge, a cyan toner printing cartridge, a magenta toner printing cartridge, and a yellow toner printing cartridge;

removing one or more of said four starting toner printing cartridges from said CMYW toner printer, such that there are one or more empty toner cartridge slots;

providing one or more non-standard toner printing cartridges that are each filled with one type of one or more non-standard toners;

installing said one or more non-standard toner printing cartridges into said one or more empty toner cartridge slots; and providing raster image processor (RIP) software, such that said CMYW toner printer is configured to incorporate said one or more non-standard toner into one or more images printed by said CMYW toner printer; and wherein said RIP software allows for remapping of said CMYW toner printer, such that the converted toner printer prints using said non-standard toner from different cartridge positions.

2. The method of claim 1, wherein said one or more non-standard toner printing cartridges each have an appropriate chip, such that when said one or more non-standard toner printing cartridges are installed in said CMYW printer said appropriate chip is configured to allow said one or more non-standard toner printing cartridges to be recognized by the CMYW toner printer.

3. The method of claim 1, wherein said one or more non-standard toner printing cartridges are selected from the group of non-standard toner printing cartridges consisting of: clear and clear fluorescent.

4. The method of claim 1, wherein said one or more non-standard toner printing cartridge is selected from the group of non-standard toner printing cartridges consisting of: clear; clear fluorescent; metallic, ceramic, light/pastel; sublimation, and security.

5. The method of claim 1, wherein said CMYW toner printer is a laser toner printer.

6. The method of claim 1, wherein said CMYW toner printer is a LED toner printer.

7. A method of converting a CMYW toner printer to print with a non-standard toner, comprising the steps:

providing a CMYW toner printer;

wherein said CMYW toner printer has four starting printing cartridges;

wherein said four starting printing cartridges comprise a white toner printing cartridge, a cyan toner printing cartridge, a magenta toner printing cartridge, and a yellow toner printing cartridge;

removing said white toner printing cartridge from said CMYW toner printer, such that there is an empty toner cartridge slot;

providing a non-standard toner printing cartridge that is filled with a non-standard toner; and installing said non-standard toner printing cartridge into said empty toner cartridge slot; and providing raster image processor (RIP) software, such that said CMYW toner printer is configured to incorporate said non-standard toner into one or more images printed by said CMYW toner printer;

wherein said RIP software allows for remapping of said CMYW toner printer, such that the converted toner printer prints using said non-standard toner from different cartridge positions.

8. The method of claim 7, wherein said non-standard toner printing cartridge has an appropriate chip, such that when said non-standard toner printing cartridge is installed in said CMYW printer said appropriate chip is configured to allow said non-standard toner printing cartridge to be recognized by the CMYW toner printer.

9. The method of claim 7, wherein said non-standard toner printing cartridge is selected from the group of non-standard toner printing cartridges consisting of: clear; clear fluorescent; metallic, ceramic, light/pastel; sublimation, and security.

10. The method of claim 7, wherein said CMYW toner printer is a laser toner printer.

11. The method of claim 7, wherein said CMYW toner printer is a LED toner printer.

12. The method of claim 7, wherein non-standard toner printing cartridge is selected from the group of non-standard toner printing cartridges consisting of: clear and clear fluorescent.

13. The method of claim 12, wherein said empty slot is a first cartridge position and said non-standard toner printing cartridge is installed into said first cartridge position and said non-standard toner is configured to underprint.

14. The method of claim 12, wherein said empty slot is a fourth cartridge position and said non-standard toner printing cartridge is installed into said fourth cartridge position and said non-standard toner is configured to overprint.

* * * * *